US007037453B2

(12) United States Patent
Ament et al.

(10) Patent No.: US 7,037,453 B2
(45) Date of Patent: May 2, 2006

(54) LAMINATE OF METAL POWDER AND FOAMING AGENT BETWEEN TWO METAL LAYERS

(75) Inventors: Peter Conrad Hubert Ament, Wormerveer (NL); Nicolaas Dirk Adrianus Kooij, Nieuwegein (NL); Christiaan Johannes Kooij, Alkmaar (NL); Anthony Stephan Verdier, Heemskerk (NL)

(73) Assignee: Corus Aluminium Walzprodukte GmbH, Koblenz (DE)

( * ) Notice: Subject to any disclaimer, the term of this patent is extended or adjusted under 35 U.S.C. 154(b) by 162 days.

(21) Appl. No.: 10/169,872

(22) PCT Filed: Jan. 17, 2001

(86) PCT No.: PCT/NL01/00034

§ 371 (c)(1),
(2), (4) Date: Nov. 5, 2002

(87) PCT Pub. No.: WO01/53023

PCT Pub. Date: Jul. 26, 2001

(65) Prior Publication Data

US 2003/0115730 A1 Jun. 26, 2003

(30) Foreign Application Priority Data

Jan. 19, 2000 (NL) ..... 1014116

(51) Int. Cl.
*B29C 44/24* (2006.01)
*B29C 44/34* (2006.01)

(52) U.S. Cl. ..... 264/42; 264/46.3; 264/46.5; 264/54; 419/2; 425/4 C; 425/112; 425/394

(58) Field of Classification Search ..... 264/42, 264/46.5, 46.3, 54; 419/2; 72/199; 425/78, 425/79, 4 C, 112, 394
See application file for complete search history.

(56) References Cited

U.S. PATENT DOCUMENTS 2,341,732 A * 2/1944 Marvin ..... 419/2
3,561,240 A 2/1971 Schey
3,661,612 A * 5/1972 Jackson et al. ..... 427/203
4,126,451 A * 11/1978 Nayar ..... 419/8

(Continued)

FOREIGN PATENT DOCUMENTS

DE 4101630 12/1991
EP 0997215 A2 5/2000

(Continued)

OTHER PUBLICATIONS

Certified English translation of EP 0997215.

*Primary Examiner*—Allan R. Kuhns
(74) *Attorney, Agent, or Firm*—Stevens, Davis, Miller & Mosher, LLP

(57) ABSTRACT

The invention relates to a process for forming a laminate comprising a core of a compressed metal powder mixed with a foaming agent between two metal layers, comprising the successive steps of providing two metal strips and a stock of powder comprising a metal powder mixed with a foaming agent; applying a layer of the powder between the two metal strips; feeding the metal strips, with the powder between them, to a rolling mill; rolling the two strips with the powder between them to form a laminate of compressed powder between two metal layers.

The invention also relates to an associated device and to the product formed using the process.

36 Claims, 1 Drawing Sheet

U.S. PATENT DOCUMENTS

| | | | | |
|---|---|---|---|---|
| 5,151,246 | A | 9/1992 | Baumeister et al. | |
| 5,393,485 | A * | 2/1995 | Worz et al. | 419/41 |
| 5,564,064 | A | 10/1996 | Martin | |
| 5,972,285 | A * | 10/1999 | Knott | 419/2 |
| 6,094,798 | A * | 8/2000 | Seeliger et al. | 29/469 |

FOREIGN PATENT DOCUMENTS

| | | |
|---|---|---|
| EP | 0997215 A3 | 11/2000 |
| FR | 1347062 | 3/1964 |
| GB | 1147326 | 4/1969 |
| WO | 9738146 | 10/1997 |

* cited by examiner

LAMINATE OF METAL POWDER AND FOAMING AGENT BETWEEN TWO METAL LAYERS

The invention relates to a process for forming a laminate comprising a core of a compressed metal powder mixed with a foaming agent between two metal layers. The invention also relates to a device for carrying out this process and to a product produced using this process.

A process of this type is known from German patent application 41 01 630. According to this document, a metal powder, mixed with a foaming agent, is compacted in order to obtain a solid intermediate. This intermediate is then extruded in order to effect considerable deformation, so that the powder particles adhere to one another, breaking up their oxide skin. The result is a firm extruded product of powder particles which are metallically bonded to one another, which can be processed as an ordinary metal.

It is then possible to form a sheet by cutting or sawing the extruded product, a metal layer being applied to two sides of this sheet. It is known to apply these layers by passing the sheet comprising powder particles having a metal sheet on either side through a rolling mill, the thickness of the overall assembly being reduced and the metal sheets becoming bonded to the sheet of powder particles. The result is a laminate of compressed powder between two metal layers.

After this known process, in a further process step this laminate is formed, by heating, into a product made of a laminate of metal foam between two metal layers as a result of the foaming powder passing into the gaseous state under the influence of the elevated temperature while the metal powder partially melts. As a result, the powder is converted into metal foam. The laminate made from compressed powder between two metal layers is usually processed first, for example is given a specific shape by pressing, and then the foaming takes place in a mould.

A drawback of the known process for obtaining a laminate of compressed metal powder between two metal layers is that a number of different process steps are required, which makes the process expensive.

Another drawback of the known process is that it is not possible to carry out the process as a continuous process, since the extruded product is available as a separate product. This also makes the process expensive, while the dimensions of the laminate formed are restricted.

It is an object of the invention to provide an improved process for forming a laminate of compressed metal powder between two metal layers.

It is another object of the invention to provide a process of this type which is simple and inexpensive to carry out.

It is yet another object of the invention to provide a process of this type which can be carried out continuously.

It is a further object of the invention to provide a device for carrying out the process which is relatively simple.

It is yet a further object of the invention to use the process to provide a laminate which is produced continuously.

One or more of these objects is/are achieved, according to the invention, by a process for forming a laminate comprising a core of a compressed metal powder mixed with a foaming agent between two metal layers, comprising the successive steps of:

- providing two metal strips and a stock of powder comprising a metal powder mixed with a foaming agent;
- applying a layer of the powder between the two metal strips;
- feeding the metal strips, with the powder between them, to a rolling mill;

- rolling the two strips with the powder between them to form a laminate of compressed powder between two metal layers.

The result is a process with which it is possible, in a simple manner, to produce a laminate of compressed metal powder between two metal layers, as a result of the compression of the powder and the bonding of the metal strips to the powder being carried out in a single step. In addition, rolling is a relatively simple process which is easy to control and manage.

According to a preferred embodiment, one of the metal strips runs substantially horizontally and the powder is applied on this metal strip, after which the other metal strip is guided onto the powder. Because the bottom strip runs horizontally, it is easy to apply the powder in a uniform thickness without the powder flowing away.

According to another preferred embodiment, the metal strips are fed to the rolling mill in a substantially vertical direction and the powder is put between the metal strips. As a result, the distance between the strips automatically determines how much powder is present between them. But it will be necessary for the edges for example to be welded or rolled together beforehand, so that the powder does not flow out between the metal strips, or other measures will have to be taken to prevent the powder from flowing away.

Preferably, at least one metal strip is supplied from a coil. In this way, the process can be carried out (semi-)continuously. If both strips are supplied from a coil, it is possible to produce great lengths of the laminate continuously.

According to an advantageous embodiment of the process, the laminate of compressed powder between two metal layers is initially coiled after rolling. Particularly if the metal strips are supplied from a coil, it is in this way easy to transport the laminate to the producer of the foamed products, since the laminate containing the compressed powder can be treated as an ordinary metal strip. However, it is also possible for the laminate of compressed powder between two metal layers to be cut into sheets after the rolling.

The metal powder used is preferably an AlSi powder. This powder can be foamed even at relatively low temperatures, which is advantageous on an industrial scale. The microstructure of the metal strips is not affected or is scarcely affected at relatively low temperatures. However, it is also possible to use metal powders of a different composition and with a low melting point.

The foaming agent used is preferably titanium hydride ($TiH_2$) powder in a quantity of from 0.5 to 15% by weight of the metal powder. If large quantities of foaming agent, for example more than 7% by weight, are used, considerable inflation of the metal powder takes place and an open cell structure is formed in the metal foam after the foaming. As a result, the metal foam is very lightweight, but on account of the open cell structure this product can only rarely be used.

Therefore, it is preferable to use from 0.5 to 7% by weight $TiH_2$, resulting in a closed cell structure, which leads to a rigid laminate of metal foam between two metal layers. More preferably, from 1 to 2% by weight $TiH_2$ is used. This results in sufficient foaming of the metal powder to obtain a lightweight and rigid laminate made from metal foam between two metal layers which can be used in practice.

According to a preferred process, aluminium strips are used for one or both metal strips. When using AlSi metal powder, the result is a fully aluminium laminate which, after foaming of the aluminium powder, can be used for numerous applications in, for example, the automotive and shipbuilding industries. For the aluminium strips, it is possible to use aluminium from the AA1xxx, AA2xxx, AA3xxx, AA5xxx, AA6xxx or AA7xxx series.

It is preferable to use aluminium strips made from an aluminium-magnesium alloy of the following composition, in percent by weight:

| | |
|---|---|
| Mg | 4.5–6.0, preferably 5.0–6.0 |
| Mn | 0.6–1.2 |
| Zn | 0.4–1.5, preferably 0.5–0.9 |
| Zr | 0.3 max, preferably 0.05–0.25 |
| Cr | 0.3 max |
| Ti | 0.2 max |
| Fe | 0.5 max |
| Si | 0.5 max |
| Cu | 0.4 max |
| Ag | 0.4 max |

as well as Al and inevitable impurities.

This alloy, which is known from European patent application 0 892 858, is eminently suitable for use in, for example, the shipbuilding industry.

According to a preferred process in which aluminium strips and AlSi powder are used, the rolling is carried out at a temperature of the strips and the powder which lies in the range from 250 to 400° C., preferably in the range from 300 to 370° C., more preferably at 335°±20° C. The temperature selected is dependent on the type of aluminium and the type of foaming agent. At these temperatures, good metallic bonding is obtained between the powder particles and also between the powder and the aluminium strips, with the aid of the rolling. The temperature should be no higher here than the temperature at which the foaming agent decomposes.

The strips and the powder are preferably preheated before being rolled.

If at least one aluminium strip and AlSi powder are used, the strips and the powder are preferably preheated to a temperature which is approximately equal to the rolling temperature, preferably to a temperature of approximately 320 to 400° C., more preferably to a temperature of approximately 350° C. Preheating to these temperatures means that the strips and the metal powder are rolled at the correct temperature.

According to a preferred process, at least one of the aluminium strips is coated with aluminium from the AA1xxx series, the coating aluminium being brought into contact with the AlSi powder. The aluminium from the AA1xxx series provides excellent bonding to the AlSi powder.

Instead of aluminium strips, it is also advantageously possible to use steel strips, resulting in a laminate of metal powder between steel strips which has different properties from a laminate with aluminium strips. In this case, it is advantageous for the metal power used to be AlSi powder, since this aluminium powder can be foamed at relatively low temperatures, but for certain applications it will be advantageous for the metal powder used to be a powder made from an alloy which substantially comprises Fe.

A second aspect of the invention provides a device for forming a laminate comprising a compressed metal powder between two metal layers using the process according to one of the preceding claims, comprising a rolling device for rolling the two metal strips with the powder comprising a metal powder mixed with a foaming agent between them, a powder-deposition device being arranged upstream of the rolls. With the aid of the powder-deposition device, the powder can be deposited on or between the bottom metal strip, after which the rolls compress the powder between the metal sheets and bond with each other and the metal sheets. The rolling also brings about a change in thickness; in the case of aluminium, for example, a powder-layer thickness of 6 mm and a strip thickness of 2 mm is converted into a laminate of powder between metal layers with a total thickness of approximately 2 mm.

The device preferably comprises a heating device for heating the powder and the metal strips.

The device preferably has unwinding means for unwinding metal strips which are provided on a coiler, and preferably also winding means for the laminate which is formed.

According to a preferred embodiment, the rolling device comprises one or more roll stands which are positioned one after the other, in order to form the laminate in two or more rolling steps.

Preferably, sealing means are arranged on either side of the rolling device, in order to prevent powder from flowing out from between the metal strips.

A third aspect of the invention provides a product produced with the aid of the process according to the first aspect of the invention, in which the laminate made from compressed metal powder between two metal layers is formed into an intermediate which is of a desired shape and, by heating, is formed into a product made from a metal layer/metal foam/metal layer laminate.

Since the laminate of compressed metal powder between metal strips can be formed continuously on a coiler with the aid of the invention, the intermediates formed, which are usually of three-dimensional shape, can easily be formed from a coil, for example by stamping and can easily be deformed by, for example, deep-drawing, as is also conventional with steel sheet or aluminium sheet. In addition, an intermediate can be heated in a mould, with the result that the metal powder is foamed and a product made from metal foam between two metal layers is formed. A laminate comprising compressed metal powder between two metal layers with a total thickness of approximately 2 mm, after foaming of the powder, can attain a total thickness of, for example, 5 to 7 mm.

Products made from a laminate of metal foam between two metal layers have a number of advantageous properties. Firstly, the laminate of metal foam between two metal layers has a relatively low specific gravity compared with a solid metal sheet, while most of the metal properties, such as rigidity, deformability, machinability, etc., are retained. In addition, this laminate has high thermal insulation properties and the soundproofing properties are also good. All these properties mean that a laminate comprising metal foam between metal layers can be used to good effect in, for example, the automotive, shipbuilding and aerospace industries.

Examples of products which can be formed include components for vehicles, such as the floor pan, the tailgate or the front panel of an automobile, components for a vessel, such as a reinforcing component for the deck or the superstructure, or a heat-resistant wall for the bottom parts of a vessel, components for trains, such as at least a section of the roof structure or the floor structure of a railway carriage, and structural parts for the interior of an aircraft, as well as also wall parts for acoustic and/or thermal insulation in a building or a means of transport.

BRIEF DESCRIPTION OF THE DRAWINGS

The invention will be explained on the basis of an exemplary embodiment and with reference to the drawing.

DETAILED DESCRIPTION OF THE PREFERRED EMBODIMENTS

Figure 1:
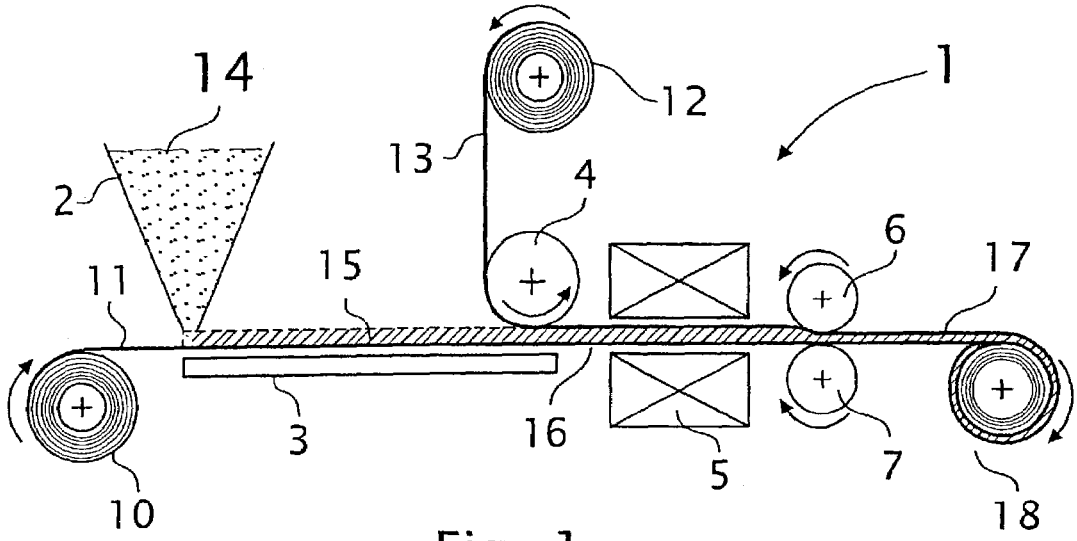
FIG. 1 diagrammatically depicts an embodiment of a rolling device according to the invention for forming a laminate from compressed metal powder between two metal layers.

As a first embodiment of the invention, FIG. 1 shows a very diagrammatic view of a device 1 comprising a powder-deposition device 2, in the form of a receptacle which is funnel-shaped in cross section and from which powder 14 can be applied on a bottom metal strip 11 which is unwound from a coil 10. The bottom metal web 11 together with the layer of powder 15 is supported by a bench 3, and a top metal strip 13, which is unwound from a coil 12, is guided onto the layer of powder by means of a roller 4. The assembly 16 which is formed in this way and comprises the bottom metal web 11, the layer of powder 15 and the top metal web 13 is then passed through a preheating furnace 5, after which rollers 6 and 7 roll the assembly 16 to form a laminate 17 comprising compressed powder between two metal layers. This laminate is then wound up to form a coil 18.

The laminate 17 is obtained in a relatively simple, continuous manner with the aid of the process carried out by the rolling device 1. Since the metal strips 11 and 13 are supplied from the coils 10 and 12 and the laminate 17 is wound up to form coil 18, the process can be largely automated.

Figure 2:
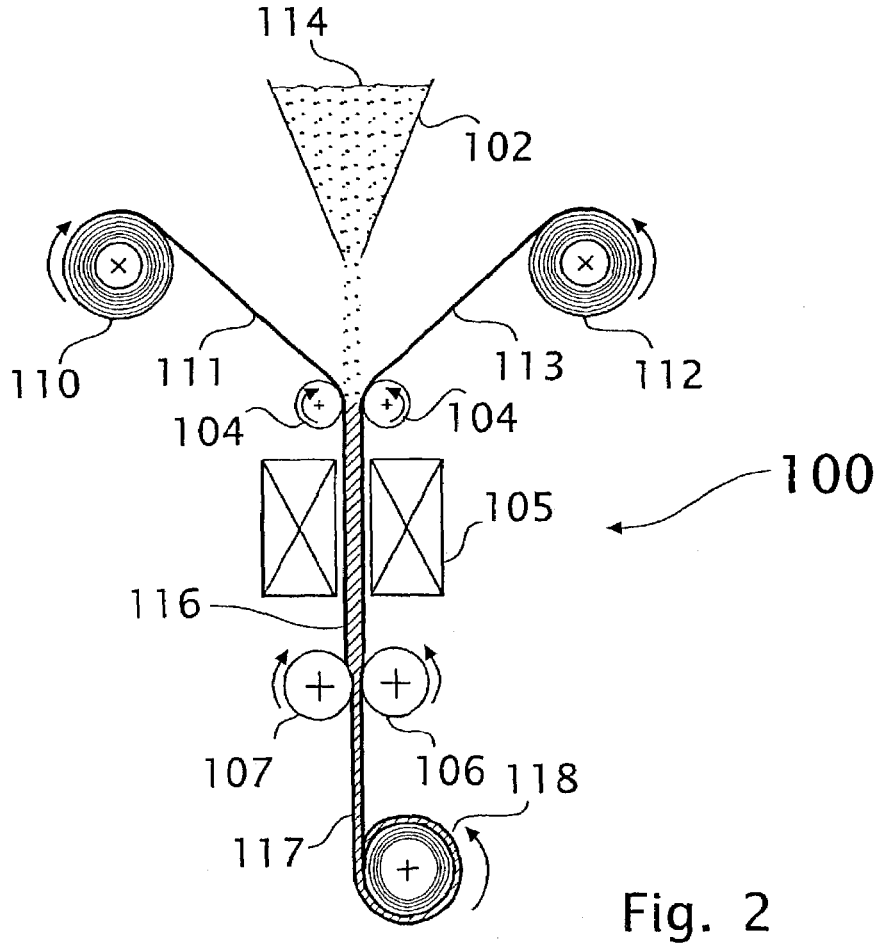
FIG. 2 diagrammatically depicts another embodiment of a rolling device according to the invention.

FIG. 2 shows a highly diagrammatic view of another embodiment of the invention. This so-called vertical embodiment is formed by a device 100 comprising a powder-metering device 102 in the form of a receptacle which is funnel-shaped in cross section. Powder 114 from the funnel-shaped receptacle 102 falls between two metal strips 111, 113 which are unwound from two coils 110, 112. The metal strips 111, 113 are supported by guide rolls 104, so that the correct quantity of powder enters between the metal strips. The assembly 116 which is formed in this way and comprises the metal strips 111, 113 with the powder between them is then passed through a preheating furnace 105, after which rollers 106 and 107 roll the assembly 116 to form a laminate 117 comprising compressed powder between two metal layers. This laminate is then wound up into a coil 118.

The process according to the invention can be used for all types of metals, for example for steel strips. However, the invention is particularly suitable for aluminium strips and aluminium powder, since the laminate formed, after foaming of the aluminium powder, can replace certain steel components used in the transport industry, for example. Since these foamed aluminium laminates combine a low weight with a high rigidity and have good insulating and damping properties because of the aluminium foam, components made from foamed aluminium laminate can be used to good effect in, for example, vehicles, vessels and aircraft.

Since the laminate 17, 117 comprising compressed metal powder and two metal layers behaves as an ordinary metal strip, this laminate can be cut or punched into blanks, for example, in the customary way, and these blanks can be formed into three-dimensional products by deep-drawing, for example. Then, the product which has been deep-drawn or shaped in some other way is heated in a mould in order to foam the metal powder, thus imparting the desired thickness to the product and leading to the formation of the laminate comprising metal foam between two metal layers.

The powder 14, 114 consists of a metal powder mixed with a foaming agent. The metal powder is, for example, AlSi, and the foaming agent is, for example, $TiH_2$, titanium hydride. The quantity of foaming agent can be selected within broad limits; a suitable quantity is from 1 to 2% by weight titanium hydride for AlSi.

If products are to be produced from foamed aluminium laminate, it is possible to start (see FIG. 1) with aluminium strips 11, 13 with a thickness of 2 mm and a layer of powder 15 with a thickness of 6 mm. The assembly 16 is then preheated in the preheating furnace 5 to approximately 350° C. and is rolled at approximately 335° C. by the rolls 6, 7 to form a laminate 17 of compressed aluminium powder between aluminium layers, with a total thickness of approximately 2 mm. The rolling temperature is dependent on the rolling force set, it being possible for the temperature to decrease as the rolling force increases. The laminate formed is ultimately converted into a foamed aluminium laminate with a thickness of from 5 to 7 mm. A similar production can be carried out using the vertical embodiment shown in FIG. 2.

It will be understood that the above exemplary embodiment does not restrict the rights applied for; other devices and processes and products formed therewith, as described in the appended claims, are also possible.

The invention claimed is:

1. Process for forming a laminate comprising a core of a compressed metal powder mixed with a foaming agent, in which the foaming agent is titanium hydride ($TiH_2$) powder in a quantity of from 0.5 to 7% by weight of the metal powder, between two metal layers, comprising the successive steps of:

providing two metal strips and a stock of loose powder comprising a loose metal powder mixed with the foaming agent;

applying a layer of the loose powder between the two metal strips;

feeding the metal strips, with the loose powder between them, to a rolling mill;

rolling the two strips with the loose powder between them to form the laminate of the compressed powder between the two metal layers.

2. Process according to claim 1, wherein one of the metal strips runs substantially horizontally and the loose powder is applied on this metal strip, after which the other metal strip is guided onto the powder.

3. Process for forming a laminate comprising a core of a compressed metal powder mixed with a foaming agent, in which the foaming agent is titanium hydride ($TiH_2$) powder in a quantity of from 0.5 to 7% by weight of the metal powder, between two metal layers, comprising the successive steps of:

providing two metal strips and a stock of powder comprising a metal powder mixed with the foaming agent;

applying a layer of the powder between the two metal strips;

feeding the metal strips, with the powder between them, to a rolling mill;

rolling the two strips with the powder between them to form the laminate of compressed powder between two metal layers, wherein the metal strips are fed to the rolling mill in a substantially vertical direction and the powder is placed between the metal strips.

4. Process according to claim 1, wherein at least one metal strip is supplied from a coil.

5. Process according to claim 1, wherein the laminate of compressed powder between two metal layers is initially coiled after rolling.

6. Process according to claim 1, wherein the metal powder used is an AlSi powder.

7. Process according to claim 1, wherein from 1 to 2% by weight $TiH_2$is used.

8. Process according to claim 1, wherein aluminium strips are used for one or both metal strips.

9. Process according to claim 8, wherein the aluminium comprises aluminium from the AA1xxx, AA2xxx, AA3xxx, AA5xxx, AA6xxx or AA7xxx series.

10. Process for forming a laminate comprising a core of a compressed metal powder mixed with a foaming agent, in which the foaming agent is titanium hydride ($TiH_2$) powder in a quantity of from 0.5 to 7% by weight of the metal powder, between two metal layers, comprising the successive steps of:

providing two metal strips and a stock of powder comprising a metal powder mixed with the foaming agent;

applying a layer of the powder between the two metal strips;

feeding the metal strips, with the powder between them, to a rolling mill;

rolling the two strips with the powder between them to form the laminate of compressed powder between two metal layers, wherein the metal strips comprise aluminium strips made from an aluminium-magnesium alloy of the following composition, in percent by weight:

| | |
|---|---|
| Mg | 4.5–6.0 |
| Mn | 0.6–1.2 |
| Zn | 0.4–1.5 |
| Zr | 0.3 max |
| Cr | 0.3 max |
| Ti | 0.2 max |
| Fe | 0.5 max |
| Si | 0.5 max |
| Cu | 0.4 max |
| Ag | 0.4 max |

as well as Al and inevitable impurities.

11. Process according to claim 1, wherein the strips comprise aluminium strips and the powder comprises AlSi powder, the rolling being carried out at a temperature of the strips and the powder in the range from 250 to 400° C.

12. Process according to claim 11, wherein the strips and the powder are preheated before being rolled.

13. Process according to claim 12, wherein the strips comprise at least one aluminium strip and the powder comprises AlSi powder, the strips and the powder being preheated to a temperature which is approximately equal to the rolling temperature.

14. Process according to claim 8, wherein at least one strip is an aluminium strip which is coated with aluminium from the AA1xxx series, the coating aluminium being brought into contact with AlSi powder.

15. Process according to claim 1, wherein the metal strips used are steel strips.

16. Process according to claim 15, wherein the metal powder comprises AlSi powder.

17. Process according to claim 15, wherein the metal powder comprises a powder made from an alloy which substantially comprises Fe.

18. A device comprising:

a loose core powder comprising loose metal powder mixed with a titanium oxide powder foaming agent in a quantity of from 0.5 to 7% by weight of the metal powder;

two metal strips, a rolling device for rolling the two metal strips with the loose core powder between the two metal strips to form a laminate of compressed said core powder between two metal layers, a powder-deposition device upstream of the rolling device for depositing the loose core powder on at least one of the two metal strips.

19. Device according to claim 18, comprising a heating device for heating the metal strips and the powder.

20. Device according to claim 18, comprising unwinding means for respectively unwinding the metal strips which are provided on a coiler.

21. Device according to claim 20, comprising winding means for winding the laminate.

22. Device according to claim 18, wherein the rolling device comprises one roll stand or more than one roll stands which are positioned one after the other.

23. Device according to claim 18, wherein sealing means are arranged on either side of the rolling device, to prevent powder from flowing out from between the metal strips.

24. Process according to claim 1, wherein the strips comprise aluminium strips and the powder comprises AlSi powder, the rolling being carried out at a temperature of the strips and the powder in the range from 300 to 370° C.

25. Process according to claim 1, wherein the strips comprise aluminium strips and the powder comprises AlSi powder, the rolling being carried out at a temperature of the strips and the powder at 335°±20° C.

26. Process according to claim 12, wherein the strips comprise at least one aluminium strip and the powder comprises AlSi powder, the strips and the powder being preheated to a temperature which is approximately equal to the rolling temperature.

27. Device according to claim 18, further comprising:

a horizontal surface upstream of the rolling device;

wherein the first means for feeding comprises means for feeding the first metal strip as a continuous piece onto the horizontal surface, along the horizontal surface and into the rolling device;

wherein the powder-deposition device is located above the first metal strip for applying the powder to an upper surface of the first metal strip;

wherein the second means for feeding comprises means for applying the second metal strip over the loose core powder located on the upper surface of the first metal strip.

28. Device according to claim 18, wherein the rolling device is arranged for discharging the laminate vertically downwardly and the powder-deposition device is positioned to deposit the loose core powder on a surface of the first metal strip and a surface of the second metal strip.

29. Process according to claim 13, wherein the strips and the powder are preheated to a temperature of approximately 320 to 400° C.

30. A device for forming a laminate comprising a core powder comprising a metal powder mixed with a titanium oxide powder foaming agent in a quantity of from 0.5 to 7% by weight of the metal powder between first and second metal layers, comprising:

first means for feeding a first metal strip;

second means for feeding a second metal strip;

a rolling device for rolling the first and second metal strips with loose said core powder between the first and second metal strips to form the laminate of compressed said core powder between the first and second metal layers, a powder-deposition device upstream of the rolling device for depositing the loose core powder on at least one of the two metal strips;

wherein the first means for feeding comprises means for feeding the first metal strip as a continuous piece extending from the first means for feeding to the rolling device.

31. The device according to claim 30, wherein the second means for feeding comprises means for feeding the second metal strip as a continuous piece extending from the second means for feeding to the rolling device.

32. The device according to claim 30, wherein the first means for feeding comprises unwinding means for unwinding the first metal strip which is provided on a coiler, wherein the first means for feeding comprises means for feeding the first metal strip as a continuous piece extending from the unwinding means to the rolling device.

33. The device according to claim 32, further comprising winding means for winding the laminate downstream of the rolling device, wherein the first means for feeding comprises means for feeding the first metal strip as a continuous piece extending from the unwinding means to the winding means.

34. Device according to claim 30, further comprising the first metal strip, wherein the first metal strip extends continuously from the first feeding means to the rolling device.

35. Device according to claim 30, further comprising:

a horizontal surface upstream of the rolling device;

wherein the first means for feeding comprises means for feeding the first metal strip as a continuous piece onto the horizontal surface, along the horizontal surface and into the rolling device;

wherein the powder deposition device is located above the horizontal surface for applying the loose core powder to an upper surface of the first metal strip;

wherein the second means for feeding comprises means for applying the second metal layer over the loose core powder located on the upper surface of the first metal strip.

36. Device according to claim 30, wherein the rolling device is arranged for discharging the laminate vertically downwardly and the powder-deposition device is positioned to deposit the loose core powder on a surface of the first metal strip and a surface of the second metal strip.

* * * * *